US006799391B1

(12) United States Patent
Bergholtz et al.

(10) Patent No.: US 6,799,391 B1
(45) Date of Patent: Oct. 5, 2004

(54) SELF-STICKING PAPER MOUNTING CORNER AND MANUFACTURING METHOD

(75) Inventors: Peter Bergholtz, 2 Pool Pl., Rockport, MA (US) 01966; Kenneth Greenhill, Milford, CT (US)

(73) Assignee: Peter Bergholtz, Rockport, MA (US)

( * ) Notice: Subject to any disclaimer, the term of this patent is extended or adjusted under 35 U.S.C. 154(b) by 0 days.

(21) Appl. No.: 10/278,452

(22) Filed: Oct. 23, 2002

(51) Int. Cl.[7] ..... A47G 1/06
(52) U.S. Cl. ..... 40/778
(58) Field of Search ..... 40/768, 773, 777, 40/778; 156/251, 252, 269

(56) References Cited

U.S. PATENT DOCUMENTS

| | | | | |
|---|---|---|---|---|
| 739,315 A | | 9/1903 | Hutton, Jr. | 40/778 |
| 846,099 A | | 3/1907 | Engstrom | 40/778 |
| 852,018 A | | 4/1907 | Engel | 40/778 |
| 950,690 A | | 3/1910 | Ewing | 40/778 |
| 1,140,904 A | | 5/1915 | Kiernan | 40/778 |
| 1,261,133 A | | 4/1918 | Kidd | 40/778 |
| 1,326,139 A | | 12/1919 | Riley | 40/778 |
| 1,351,560 A | | 8/1920 | Engel | 40/778 |
| 1,355,694 A | | 10/1920 | Riley | 40/778 |
| 1,386,771 A | | 9/1921 | Engel | 40/778 |
| 1,480,879 A | | 1/1924 | Bowler | 40/778 |
| 1,493,159 A | | 5/1924 | Milmoe | 40/778 |
| 1,526,537 A | | 2/1925 | Engel | 40/778 |
| 1,627,667 A | | 5/1927 | Riley | 40/778 |
| 1,652,471 A | | 12/1927 | Engel | 40/778 |
| 1,741,350 A | | 12/1929 | Swift | 40/778 |
| 1,742,615 A | | 1/1930 | Riley | 40/778 |
| 1,791,098 A | | 2/1931 | Lartz | 40/778 |
| 1,799,221 A | | 4/1931 | Engel | 40/778 |
| 1,811,116 A | | 6/1931 | Engel | 40/778 |
| 1,852,744 A | | 4/1932 | Engel | 40/778 |
| 1,853,066 A | | 4/1932 | Maclean | 40/778 |
| 1,863,430 A | | 6/1932 | Woerner, Jr. | 40/778 |
| 1,870,528 A | * | 8/1932 | Leopold | 40/778 |
| 1,895,599 A | * | 1/1933 | Otto | 40/778 |
| 1,927,338 A | | 9/1933 | Engelmann | 40/778 |
| 1,968,674 A | | 7/1934 | Engel | 40/778 |
| 1,970,395 A | | 8/1934 | Schaake | 40/778 |
| 1,976,607 A | | 10/1934 | Engel | 40/778 |
| 1,999,423 A | | 4/1935 | Riley | 40/778 |
| 2,068,909 A | | 1/1937 | Engel | 40/778 |
| 2,085,187 A | | 6/1937 | Engel | 40/778 |
| 2,140,660 A | | 12/1938 | Warshaw | 40/778 |
| 2,265,147 A | * | 12/1941 | Condon | 40/778 |
| 2,292,582 A | | 8/1942 | Tate | 40/778 |
| 2,335,793 A | | 11/1943 | Ruppin | 40/778 |
| 2,360,693 A | * | 10/1944 | Lartz | 40/778 |
| 2,418,421 A | | 4/1947 | Murray | 40/778 |
| 2,438,997 A | | 4/1948 | Hall | 40/778 |
| 2,451,646 A | | 10/1948 | Ainswoth | 40/778 |
| 2,493,276 A | | 1/1950 | Thurston | 40/778 |
| 2,534,919 A | | 12/1950 | Lartz | 40/778 |
| 2,575,924 A | | 11/1951 | Miner | 40/778 |
| 2,611,369 A | | 9/1952 | Herrick | 40/778 |
| 2,622,055 A | | 12/1952 | Lieder | 156/251 |

(List continued on next page.)

FOREIGN PATENT DOCUMENTS

| | | |
|---|---|---|
| DE | 398295 | 6/1923 |
| DE | 697755 | 6/1939 |

*Primary Examiner*—S. Joseph Morano
*Assistant Examiner*—Lars A Olson
(74) *Attorney, Agent, or Firm*—Kirkpatrick & Lockhart LLP

(57) ABSTRACT

Corner mounts for photographs or other sheet-like articles are provided with a pressure-sensitive adhesive. Each corner mount includes a base sheet and a cap, both made from paper and adhesively attached to each other to define a pocket receptive to a corner of the article to be mounted. The underside of the base sheet has a pressure-sensitive adhesive that is covered by an easily separated liner. The corner mounts may be made in large quantities on high speed flexographic printing machinery.

27 Claims, 4 Drawing Sheets

U.S. PATENT DOCUMENTS

| | | | | | |
|---|---|---|---|---|---|
| 2,791,948 | A | | 5/1957 | Flood | 40/778 |
| 2,825,166 | A | | 3/1958 | Flood | 40/778 |
| 2,841,903 | A | | 7/1958 | Christensen | 40/778 |
| 2,844,900 | A | | 7/1958 | Miller | 40/778 |
| 2,956,612 | A | | 10/1960 | Gaines et al. | 40/778 |
| 3,000,638 | A | | 9/1961 | Dennis | 40/778 |
| 3,023,678 | A | * | 3/1962 | Gerold | 40/778 |
| 3,125,460 | A | | 3/1964 | Rose | 40/778 |
| 3,256,979 | A | * | 6/1966 | Gerold | 40/778 |
| 3,259,270 | A | | 7/1966 | Eckles | 40/778 |
| 3,346,979 | A | | 10/1967 | Milos | 40/778 |
| 3,386,199 | A | | 6/1968 | Nagatsuka | 40/778 |
| 3,766,676 | A | | 10/1973 | Slemmons | 40/778 |
| 3,810,324 | A | | 5/1974 | Hart | 40/778 |
| 3,831,301 | A | | 8/1974 | Reynard | 40/778 |
| 3,893,252 | A | | 7/1975 | Chase | 40/778 |
| 3,921,322 | A | | 11/1975 | Sharp | 40/778 |
| 4,141,162 | A | | 2/1979 | Mascolo | 40/778 |
| 4,268,000 | A | | 5/1981 | Ulm | 40/778 |
| 4,785,562 | A | | 11/1988 | Good | 40/778 |
| 4,991,330 | A | | 2/1991 | Heidari | 40/778 |
| 5,040,216 | A | | 8/1991 | Policht | 40/778 |
| 5,183,296 | A | | 2/1993 | Policht | 40/778 |
| 5,226,996 | A | | 7/1993 | Schober | 40/778 |
| 5,433,023 | A | | 7/1995 | Edwards et al. | 40/778 |
| 5,502,547 | A | | 3/1996 | Shirai | 40/778 |
| 5,947,437 | A | | 9/1999 | Tate et al. | 40/778 |
| 6,010,000 | A | | 1/2000 | Tran | 40/778 |
| 6,056,494 | A | | 5/2000 | Fong | 40/778 |
| 6,101,752 | A | | 8/2000 | Cumberland | 40/778 |
| 6,202,838 | B1 | | 3/2001 | Tran | 40/778 |
| 6,257,621 | B1 | | 7/2001 | Smith | 40/778 |
| 6,370,805 | B2 | | 4/2002 | Thompson | 40/778 |
| 6,389,724 | B1 | | 5/2002 | Cumberland | 40/778 |
| 6,401,376 | B2 | | 6/2002 | Cumberland | 40/778 |

* cited by examiner

FEED ROLL
KRAFT PAPER
SELF STICK
ADHESIVE
LINER/CARRIER
STOCK

PRINT
ADHESIVE
PATTERN

FEED ROLL
CAP PAPER

DIE-CUT CAP
AND EMBOSS
WASTE REMOVED

DIE-CUT
TO LINER
FINISHED PRODUCT
BONDING
OF THE WEB

FEED ROLL
KRAFT PAPER
SELF STICK
ADHESIVE
LINER/CARRIER
STOCK
36
34
32
33

PRINT
ADHESIVE
PATTERN
41

FEED ROLL
KRAFT PAPER
41
50
68
48

EMBOSS
PAPER CAP
27
66
44
46
BONDING
OF THE WEB

DIE-CUT CAP
PATTERN
55
52
WASTE REMOVED
57
54

DIE-CUT
BASE PATTERN
TO LINER
59
41
36
34
32
56
58
FINISHED PRODUCT

SELF-STICKING PAPER MOUNTING CORNER AND MANUFACTURING METHOD

FIELD OF THE INVENTION

This invention relates to corner mounts for sheet-like articles such as photographs, and methods for making and using such corner mounts.

BACKGROUND

Corner mounts, by which a photograph, card or other sheet may be mounted to a surface, have been in use for decades. U.S. Pat. No. 1,742,615, dated Jan. 7, 1930 (Riley), describes a configuration for a paper corner mount and a process for its manufacture that still are in use today. U.S. Pat. No. 1,355,694, issued Oct. 12, 1920 (Riley) describes an earlier paper corner mount. Each of the Riley patents describes a corner mount in which a paper blank is formed to have selected marginal or corner portions that are folded over to form a pocket receptive to a corner of a photograph or the like. The folded-over margins are retained in the pocket configuration either by selective placement of adhesive or by a second sheet or "cap" that overlies and is adhesively attached to the exposed surfaces of the folded over margins. The underside of the mounting corner is coated with a water-based gum adhesive. The portions of the corner mount that form the pocket typically are embossed to form out-of-plane ridges that project from the inner surface of the cap into the pocket. The ridges are arranged so that when the corner of a photograph or card is inserted into the pocket, they will engage the corner sufficiently to hold itself onto the corner of the photograph as the photograph is manipulated into position on the mounting surface. That permits the corner mounts to be placed on all the corners of the photograph before any of the gummed bottom surfaces are moistened. Thus all of the gummed bottom surfaces may be moistened at about the same time and promptly applied, together, in the correct relative position to the surface to which the photograph is to be mounted.

It has been recognized that it would be more convenient to provide a corner mount that used a self-stick adhesive that did not require moistening in order to activate the adhesive. To that end, mounting corners have been made, and are commercially available, in which the corner is coated on its underside with a pressure sensitive adhesive that is covered by a peelable layer from which the mounting corner is removed in order to expose the adhesive. Such mounting corners, however, are made from plastic sheets or films. Such plastic corner mounts are considered to compromise the advantages of paper corner mounts in order to avoid the necessity of moistening the corner mounts before applying them to the mounting surface. Among the disadvantages of corner mounts formed from plastic is that they do not lend themselves to embossing to form projections or ridges that project into the pocket. Consequently, they do not grip the corner of the photograph as well as embossed paper corners. Moreover, the embossed pattern also provides somewhat of an aesthetic appearance which is not readily duplicated with a plastic device. Additionally, plastic corner mounts are believed to be formed using heat sealing techniques and may not have the archival qualities that are achievable with paper construction.

It would be desirable to provide self-sticking paper mounting corners and methods for their manufacture.

SUMMARY

The invention enables manufacture of paper corner mounts using printing machinery capable of adhesively joining layers of paper and then selectively cutting the sandwiched web to leave a group of corner mounts that are releasably and individually attached, by a pressure sensitive adhesive, to a supporting release liner. The arrangement enables a corner mount to be detached by inserting the corner of a photograph or the like into the pocket of a corner mount on the release liner and then manipulating the photograph to separate the corner mount from the release layer. The layer of pressure sensitive adhesive remains with the detached corner mount so that the photograph, together with the corner mounts simply can be pressed against the page or other support surface to which the corner mounts are to be attached. By forming the corner mounts from paper they are embossed easily during the manufacturing process to provide a decorative, aesthetic appearance and corner-gripping projections, as well as to enable the manufacture of an archival product. The construction of the corner mounts embodying the invention enables them to be made economically on high speed web printing machinery, such as flexographic label printers.

DESCRIPTION OF THE DRAWINGS

An illustrative embodiment of the invention is illustrated in the drawings in which.

DETAILED DESCRIPTION

Figure 1:
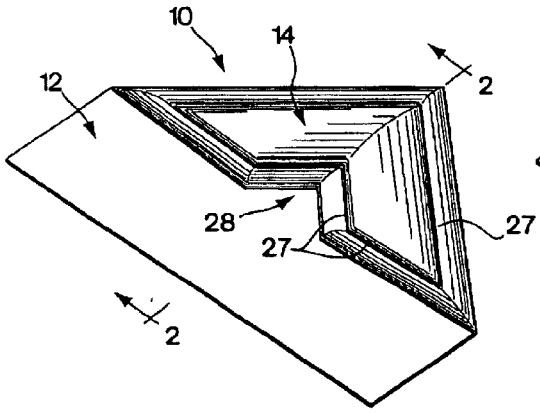
FIG. 1 is an isometric illustration of an individual corner mount.

FIG. 1 illustrates a preferred embodiment of a completed individual corner mount 10. The corner mount 10 includes a paper base sheet 12 and a paper cap 14. The base sheet 12 may be considered as having a pair of corner-defining edges 16 that meet at a defined angle, typically about a right angle, a pair of spaced, parallel side edges 18 and a base edge 20. The cap 14 overlies the corner region of the base sheet 12 defined by the edges 16 and includes corner edges 22 that are aligned with the corner edges 16 of the base sheet 12. The corner edges 16, 22 of the base sheet and cap are attached to each other by a thin strip of adhesive 24 extending along a narrow marginal portion of the edges 16, 22 (see FIG. 1A).

The remaining edge 23 of the cap 14 remains unattached to the base sheet 12 to define an entry 26 for a corner of a photograph or the like into a receptive pocket 25 defined between the base sheet 12 and cap 14. No folding of margins of the base sheet 12 or cap 14 is required. The portion of the cap 14 disposed inwardly of the adhesive strips 24 preferably is embossed to form projections 27 extending into the pocket by which the grip of the corner mount 10 on the corner of the photograph is enhanced. The open edge 23 may be formed to include a notch 28 for aesthetic purposes. The underside of the base sheet 12 is coated with a pressure sensitive adhesive 30 that, before the corner mount is used, is covered by a liner in the form of a release layer 32 (see FIG. 4) to which the adhesive 30 has relatively low adhesion, thereby enabling the base sheet 12 and adhesive layer 30 to be separated easily from the release layer. As described in further detail below, it is desirable to provide a plurality of such mounting corners on a single sheet of release layer as shown, for example, in FIG. 3.

It should be understood that although the preferred embodiment of corner mounts is shown as having traditional corner-defining edges 16, 22 arranged at about right angles, the invention is not limited to mounts having that configuration. The edges defined by the base sheet 12 and cap 14 may be curved or may be provided with other non-linear or patterned shapes. Therefore, the term "corner-defining edges" as used herein is intended to include not only traditional corner configurations but also curved or other non-linear shapes for the joined edges. Similarly, although the preferred embodiment is described as including a notch 28 along the open edge 23 of the cap 14, other linear or non-linear shapes or patterns may be selected for the open edge 23.

Figures 4, 4A, 4B, 4C, 4D, 4E:
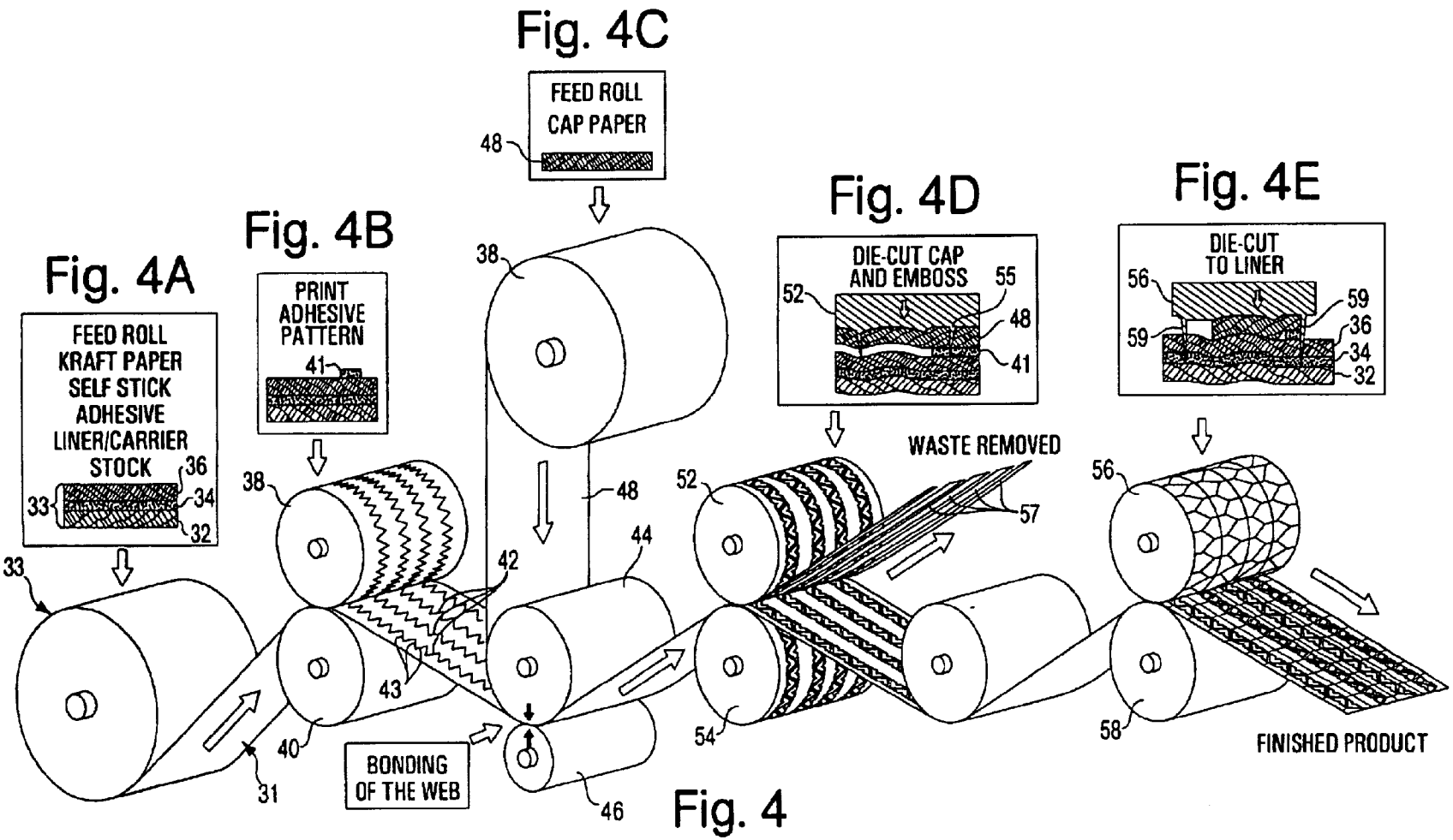
FIG. 4 is a diagrammatic illustration of one sequence of manufacturing operations having a sequence of stations at which the manufacturing operations may be performed.
FIGS. 4A–4E are sequential sectional illustrations of the configuration of the array of mounting corners at sequential stations of FIG. 4.

FIG. 4 shows, diagrammatically, an arrangement and process for making arrays of self-sticking paper mounting corners in accordance with the invention. In a preferred embodiment, the mounting corners may be made in a flexographic printing press such as, for example, a type commercially available under the trade designation Webtron. In such a press, continuous webs of material may be fed into series of rollers which, at a series of stations, apply, adhere and cut the webs to form the finished product, at a high speed and with a high degree of precision. In the preferred method of manufacturing the mounting corners, a roll of prepared stock 33 is provided. The stock may comprise a web 31 about four inches wide and has three layers (FIG. 4A) including a bottom layer which serves as the release liner 32, a layer of pressure sensitive adhesive 34 and a top layer 36 of paper that will form the base sheets 12 of the corner mounts.

The web of prepared stock is fed between a pair of printing rollers 38, 40 which print a thin film of adhesive 41 in a selected pattern on the upper face of the paper top layer 36 (FIG. 4B). The pattern of adhesive applied to the paper layer 36 of the web is selected with respect to the pattern in which the individual corner mounts will be formed in the succeeding manufacturing steps. In the illustrated embodiment, the adhesive is placed in a series of zigzag lines 42.

The adhesive should be one that is readily usable in the printing machinery employed. For example, when using flexographic printing equipment, the adhesive should have ink-like characteristics, such as a printable viscosity of the order of 1,500 to 4,500 centipoise. The adhesive should be fusitive, that is, it should have characteristics such that it will impregnate the fibers of the sheets sufficiently that, when the adhesive is cured, it results in a permanent bond. Preferably, the bond should be such as to result in fiber tear if it is attempted to separate the bonded sheets. The adhesive preferably should not be gummy, at least by the time it has been advanced to the die cutting stage of the manufacturing procedure, in order to avoid gumming of the cutting dies or other portions of the machinery. The invention enables the use of such an adhesive having a substantially neutral pH when dry, in order to enhance the archival quality of the finished corner mount. The adhesive also should have the ability to be transferred from the printing roller to the paper without spreading out or running on the paper once applied. The adhesive should have tack characteristics sufficient to hold the top layer of paper firmly in place immediately upon application of the top layer. For example, a satisfactory adhesive is commercially available form Greenhill Associates of Milford, Conn. under the trade designation E612-11. It should be understood, however, that the invention is not limited to the particular adhesive and that other adhesives are within the scope of the invention, depending on a number of other variables, for example, the machinery on which the corner mounts are made as well as the characteristics of the particular papers from which the corner mounts are made.

After emerging from the printing rolls 38, 40, the web is guided through a pair of pressure rolls 44, 46 to which a web 48 of cap paper is fed from a supply roll 50. The web 48 is guided onto the upper surface of the top layer 36 of the web 31 and into the nip between the pressure rollers 44, 46. The paper 48, from which the caps 14 will be formed, is adhered to the top layer 36 of the web 31 along the zigzag adhesive lines 42. After emerging from between the rolls 44, 46, the web may be considered as having five layers, with the cap layer 48 being attached to the top layer 36 along the pattern(s) in which the adhesive layer 41 was imprinted. It should be understood that in each of FIGS. 4A–4E the layers are shown to have sufficient thickness for purposes of clarity of illustration. For example, the adhesive layer defined by the pattern 42 may impregnate and merge into the fibers of the base paper 36 and cap paper 48 and may not appear as a clear and distinct layer. FIGS. 4A–4E are intended merely to illustrate the relative location of the papers and adhesives and the depth of the cuts. They are intended as diagrammatic only.

The five-layer web then is advanced to a pair of embossing and cutting rolls 52, 54 that are configured to die cut to, but not through, the base layer 36, By the time the web reaches the embossing and cutting rolls 52, 54, the adhesive 41 should be cuttable without leaving gum or residue on the rolls 52, 54. The cuts 55 (FIG. 4D) are made through the cap paper layer 48 and adhesive layer 42. The base paper 36 and pressure sensitive adhesive 34 remain intact through this stage.

Figure 1A:
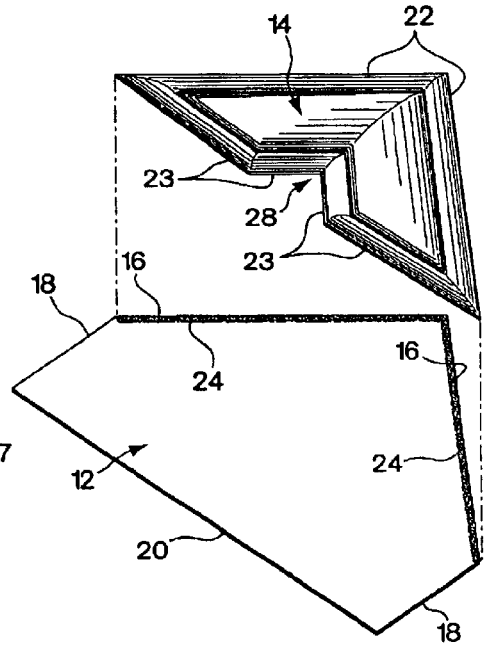
FIG. 1A is an exploded illustration of the base sheet and cap of an individual corner mount showing margins along which the base sheet and cap are adhesively attached to each other.

The cuts 55 are made so that the portions that will define the corner edges 22 of the caps 14 are made along the zigzag pattern 42 of the adhesive 41. Thus, each segment of the zigzag adhesive pattern is bisected along its length so that a half-width portion of each leg 43 of the zigzag pattern will remain to join the margins 24 of registered edges 16, 22 of the base and cap sheets 12, 14, respectively, in each individual corner mount (FIGS. 1A and 4D).

The web emerging from between the rolls 52, 54 may be considered as defining a cap sheet having rows of cut and embossed caps defined by the corner edges 22 with the orientation of the caps being staggered and nested. The regions of the cap paper 48 that lie between the nested rows of embossed and cut caps define waste strips 57 that may be separated from the remaining portion of the product.

The web emerges from the die cut rolls 52, 54 and is guided to a second die-cutting station where another pair of die cut rolls 56, 58 make a deeper cut through the base paper layer 36 and the pressure sensitive adhesive layer 34. The die cut rolls 56 are arranged so that a portion of their cutting edges register with the previously formed die cuts 55. The cuts 59 are made to but not through the liner layer 32. The cuts 59 are made to define the side edges 18 and base edge 20 as well as to cut the base sheet 12 along a line or lines in registry with the cap edges 22. In the illustrated embodiment in which corner defining portions of adjacent caps are nested, the base edges 20 of the corner mounts 10 that extend along one of the rows may abut the base edges of a series of corner mounts in an adjacent third row. The finished product may be wound on a roll and may be cut into shorter lengths shown in FIG. 3.

Figure 3:
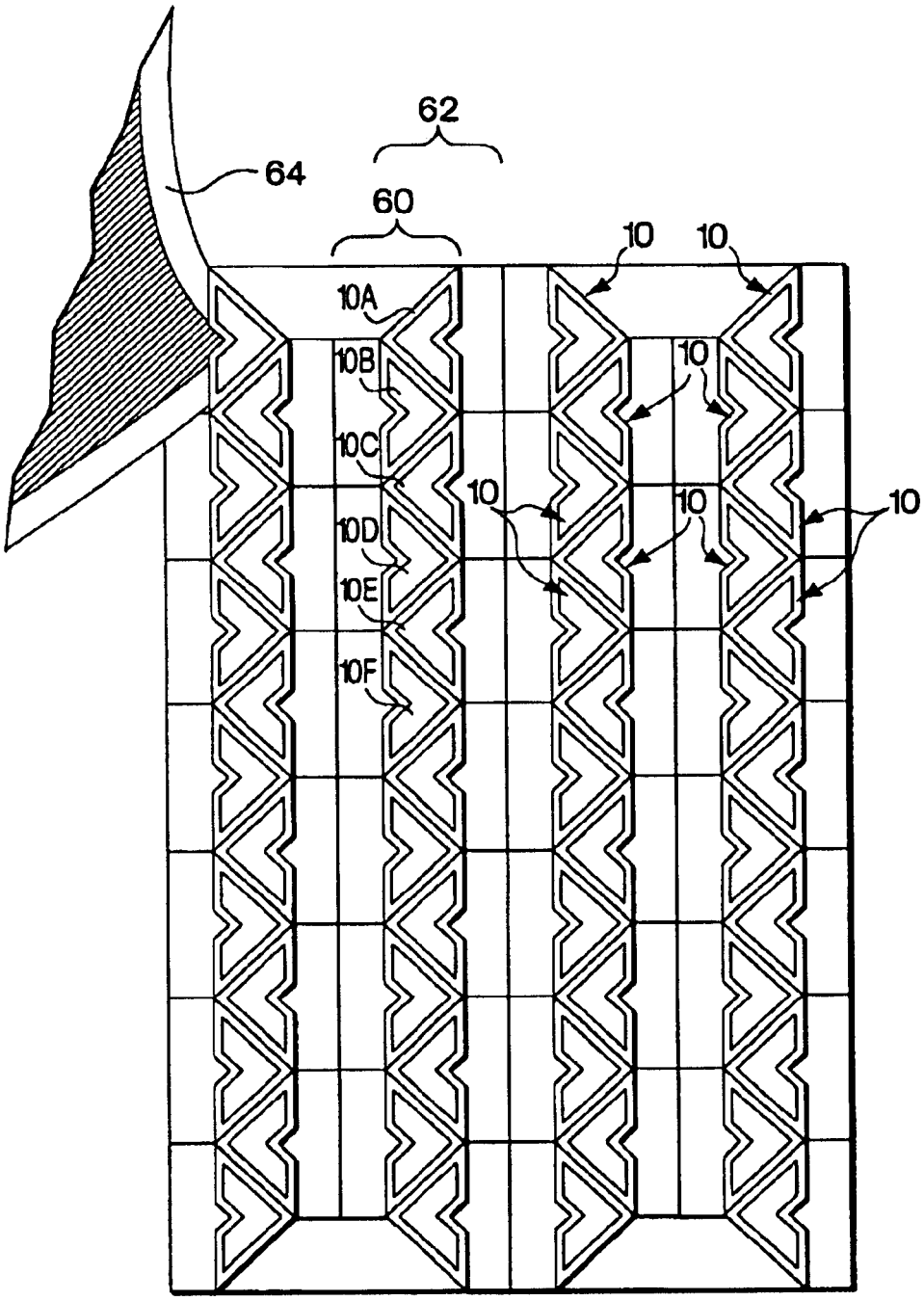
FIG. 3 is an illustration of a plurality of corner mounts mounted on a release liner with a photograph inserted into the corner of one of the corner mounts in readiness to detach the corner mount from the supporting liner.

As shown in FIG. 3, one pattern for the array of completed corner mounts 10 on the release sheet 32 includes at least two rows, 60, 62 of corner mounts 10 in which the corner mounts of one row are staggered with respect to the corner mounts of the immediately adjacent row of that pair. For example, the row 60 may be considered as extending along the corner mounts 10 identified as 10*b*, 10*d*, 10*f*, etc. The row 62 may be considered as being defined by the corner mounts 10*a*, 10*c*, 10*e*, etc. By staggering the corner mounts, their corner regions may be formed to nest with each other so that the corner edges 16, 22 of each corner mount will lie adjacent and parallel to the corner edges 16, 22 of the immediately adjacent corner mounts in that pair of rows. Thus, the immediately adjacent corner edges of the individual corner mounts in the pair of rows define a continuous zigzag pattern corresponding to that of the zigzag adhesive line 42 along which the base and cap papers 36 and 46 were joined. The zigzag adhesive line 42 should be placed on the base paper 12 in a sufficient width to enable the die cut of the rolls 52, 54 to sever the strip along its midline.

FIG. 3 also illustrates the manner in which the array of corner mounts may be used to attach a photograph, card or the like to a sheet or other surface to which the photograph is to be mounted. A corner of the photograph 64 is inserted into a pocket of any of the corner mounts while the corner mount remains attached to the release sheet Holding the photograph and the array of photocorners, the array is pulled away from the corner mount while the corner mount is held by the photograph (or vice versa). The corner mount, together with the pressure sensitive adhesive, separates from the release sheet. While the detached mounting corner is retained on the photograph, other corner mounts may be attached to the other corners of the photograph and separated from the release layer. With the desired number of corner mounts on the photograph, the assembly can be pressed in place on an intended support surface, such as a page in a photo album.

The characteristics of the papers from which the corner mounts are made may be varied. By way of example, Kraft paper of about 40 to about a 50 weight having a substantially neutral pH (acid free) may be used. Colored papers should be colorfast and the adhesives must not migrate or change state over time to avoid damage to the mounted object, providing archival quality. For example, only, the paper used may be of the order of 1.2 to 1.5 mils thick.

Figure 2:
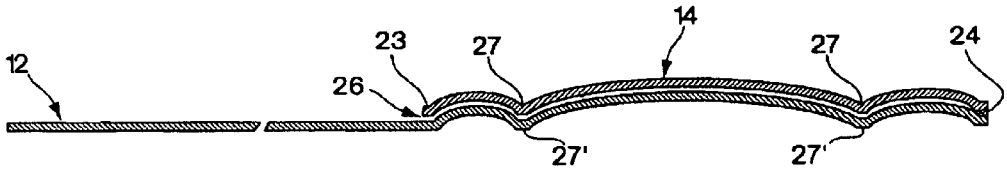
FIG. 2 is a sectional illustration of the corner mount of FIG. 1 as seen along the line 2—2 of FIG. 1.
Figure 6:
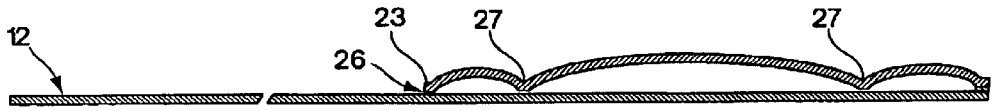
FIG. 6 is a sectional illustration of the corner mount manufactured according to the procedure shown in FIG. 5.
Figures 5, 5A, 5B, 5C, 5D, 5E, 5F:
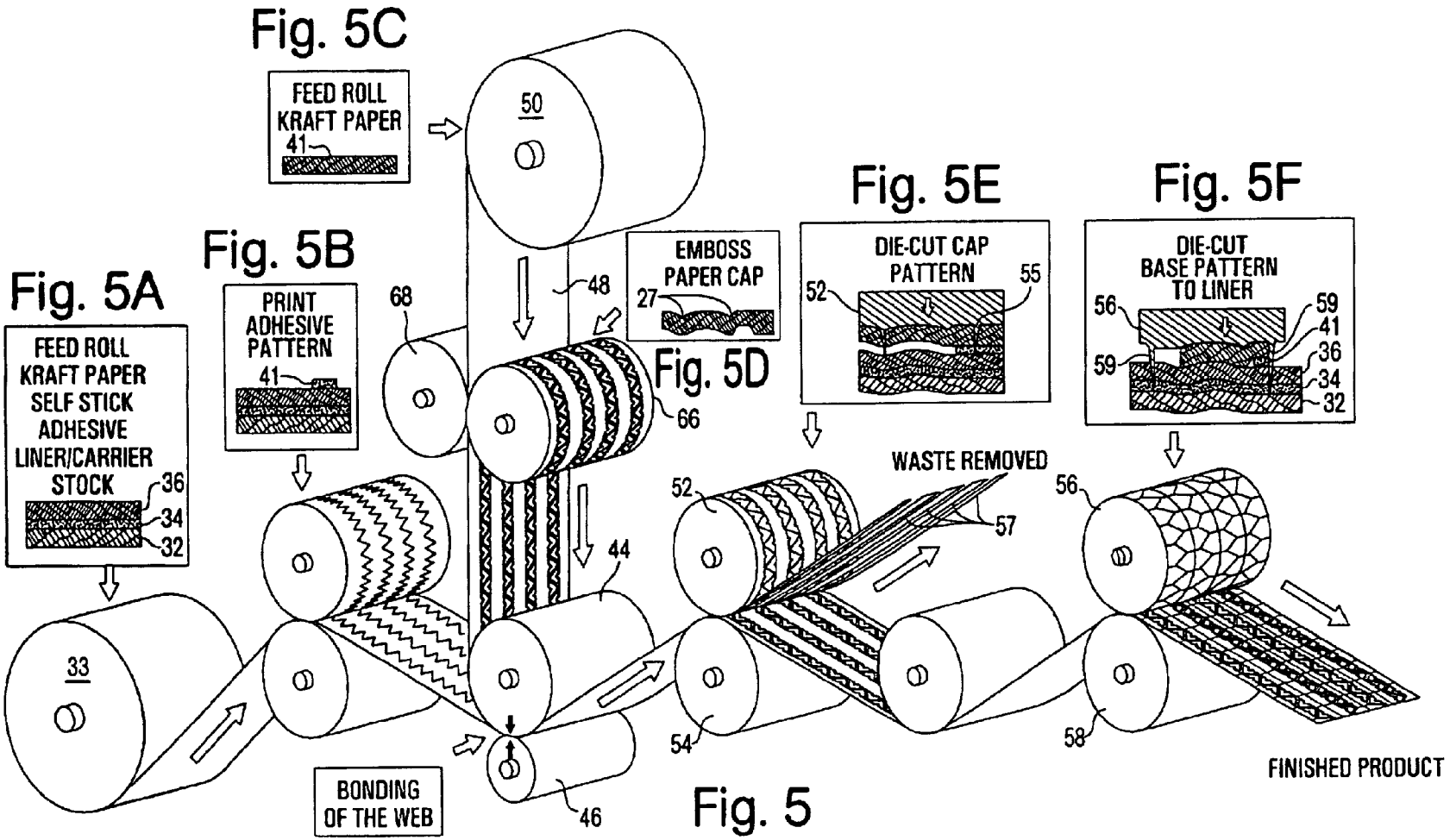
FIG. 5 is a diagrammatic illustration of another manufacturing sequence in which the web of cap paper is pre-embossed before it is joined to the base sheet and where the base sheet remains unembossed.
FIGS. 5A–5F are sequential illustrations of the configuration of the array of mounting corners at the sequential stations of FIG. 5.

If the embossing step to form the ridges 27 in the cap 14 is performed after the web 48 of cap paper has been attached to the web of base paper, as in FIG. 4, the impression made by the ridge-forming roller dies 52, 54 may transfer partly through to the base paper as suggested at 27' in FIG. 2. It may be desirable, therefore, to employ an alternate sequence of assembly in which the cap paper 48 is pre-embossed with projections, such as ridges, before the web 48 is fed into the pressure rolls 44, 46. So manufactured, the resulting product will have ridges formed in the cap 14 but not in the base paper 12, as suggested in FIG. 6. Such pre-embossing may be accomplished by modifying the process as shown in FIG. 5 to direct the web 48 of cap paper, from its supply roll 50, through embossing rollers 66, 68 before the web 48 is advanced to the pressure rollers 44, 46. When so manufactured, care must be taken to assure precise registry of the adhesive lines 42 with respect to the location of the embossed projections 27 so that the adhesive will be spaced from the projections and not interfere with the sheet gripping function of those projections. In this modification, the rolls 52, 54 perform a cutting, but not an embossing step. FIGS. 5A–5F illustrate in diagrammatic section, the state of the webs at the various stations.

It should be understood that the foregoing description of the invention is intended merely to be illustrative thereof and that other modifications, embodiments and equivalents may be apparent to those who are skilled in the art without departing from its spirit. Having thus described the invention what we desire to claim and secure by letters patent is:

What is claimed is:

1. A plurality of corner mounts for detachable engagement with the corner of a sheet-like article comprising:

each corner mount comprising a paper base sheet and a paper cap attached directly to marginal portions of the base sheet and defining a pocket in cooperation with the base sheet, the pocket being receptive to a corner of a sheet-like article;

the underside of each base sheet being removably attached by a pressure sensitive adhesive to a common release sheet from which individual of said corner mounts can be detached together with its associated pressure sensitive adhesive.

2. A corner mount arrangement as defined in claim 1 wherein each of the base sheet and cap has corner edges, the base sheet and cap being adhesively attached to each other along the margins of their respective corner edges.

3. A corner mount arrangement as defined in claim 2 further comprising the underside of the cap having a projection extending toward the base sheet into the pocket.

4. A corner mount arrangement as defined in claim 2 wherein the corner edges are substantially straight and meet at about a right angle.

5. A corner mount arrangement as defined in claim 2 wherein the corner edges are non-linear.

6. A corner mount arrangement as defined in claim 2 wherein the marginal adhesive is water based.

7. A corner mount arrangement as defined in claim 3 wherein the projection comprises a ridge embossed in the cap paper.

8. A corner mount arrangement as defined in claim 1 further comprising the cap having a projection that extends toward the base sheet into the interior of the pocket.

9. A corner mount arrangement as defined in claim 8 wherein the projection comprises a ridge embossed in the cap paper.

10. A corner mount as defined in claim 1 wherein the base sheet and cap are free of folded portions.

11. A new corner mount arrangement as defined in claim 1 where each of the base sheet, cap and adhesives is of archival quality.

12. An array of corner mounts for detachable engagement with the corner of a sheet-like article comprising:

a liner sheet;

a plurality of corner mounts, each corner mount including a paper base sheet and an attached pocket-defining paper cap;

the corner mounts being attached to the liner sheet by a pressure sensitive adhesive disposed between the underside of the base sheet and the liner sheet, the pressure sensitive adhesive being adopted to release from the liner sheet and remain attached to the paper base sheet when the corner mount is separated from the liner sheet; and the corner mounts being arranged on the liner sheet in a pair of adjacent parallel rows.

13. An array of corner mounts as defined in claim 12 wherein the bottom edge of base sheets of adjacent rows lie adjacent each other.

14. An array of corner mounts as defined in claim 12 further comprising the base edges in a pair of adjacent rows lying adjacent each other and the caps of adjacent rows lying adjacent each other.

15. An array of corner mounts as defined in claim 14 wherein the adjacent caps of adjacent rows are nested.

16. An array of corner mounts as defined in claim 12 further comprising the corner mounts in adjacent rows being staggered so that the caps of corner mounts in one row are nested with the caps of the corners of the adjacent row.

17. A corner mount arrangement as defined in claim 12 where each of the base sheet, cap adhesives is of archival quality.

18. A method for making paper mounting corners, a paper base sheet and a paper cap sheet attached to the base sheet, and having a pressure sensitive adhesive on the underside of the base sheet comprising:

providing a multi-layer web that includes a first liner layer, a second pressure sensitive adhesive layer and a third paper base layer;

applying another adhesive, defining a fourth layer, to the third layer, the fourth layer being applied in a predetermined pattern;

applying a fifth layer of paper to the adhesive-coated third layer;

pressing the fifth layer to the third layer to cause them to adhere only along the predetermined adhesive pattern of the fourth layer;

cutting the fourth and fifth layers of the web to, but not through, the third layer in a pattern that defines the periphery of a cap sheet of a corner mount, the cutting including the step of cutting the web along the predetermined adhesive pattern; and cutting through the web to, but not through, the liner layer in a pattern to define a base sheet.

19. A method as defined in claim 18 wherein the pattern of the cap sheet has a smaller area than the pattern of the base sheet.

20. A method as defined in claim 18 wherein the embossing step is applied to the fifth layer before the fifth layer is pressed to the third layer.

21. A method as defined in claim 18 wherein the steps of applying the fourth and fifth layers, pressing the fifth layer to the third layer and cutting the web are performed by a flexographic printing process.

22. A method as defined in claim 18 wherein all of the steps are performed in a flexographic printing machine.

23. A method as defined in claim 18 further comprising the adhesive of the fourth layer being adapted to have tack characteristics to prevent shifting of the third and fifth layers from the position in which they were pressed together.

24. A method as defined in claim 23 wherein the adhesive defining the fourth layer is selected to be adapted to have non-gumming characteristics before the fifth layer is cut.

25. A method as defined in claim 18 further comprising:

embossing the fifth layer of paper to form a projection in the fifth layer that extends toward the third layer.

26. A method as defined in claim 25 wherein the embossing step is performed after the fifth layer has been pressed to the third layer.

27. A corner mount arrangement as defined in claim 18 where each of the base sheet, cap adhesives is of archival quality.

* * * * *